US008823594B2

(12) United States Patent
Hamabe

(10) Patent No.: US 8,823,594 B2
(45) Date of Patent: Sep. 2, 2014

(54) ANTENNA APPARATUS INCLUDING FIRST AND SECOND MONOPOLE ANTENNAS EACH HAVING LOOP PORTION

(75) Inventor: Taichi Hamabe, Hyogo (JP)

(73) Assignee: Panasonic Corporation, Osaka (JP)

( * ) Notice: Subject to any disclaimer, the term of this patent is extended or adjusted under 35 U.S.C. 154(b) by 240 days.

(21) Appl. No.: 13/596,482

(22) Filed: Aug. 28, 2012

(65) Prior Publication Data

US 2013/0002497 A1 Jan. 3, 2013

Related U.S. Application Data

(63) Continuation of application No. PCT/JP2011/006945, filed on Dec. 13, 2011.

(30) Foreign Application Priority Data

Mar. 16, 2011 (JP) ..... 2011-057495

(51) Int. Cl.

| | |
|---|---|
| ***H01Q 21/00*** | (2006.01) |
| ***H01Q 1/38*** | (2006.01) |
| ***H01Q 9/42*** | (2006.01) |
| ***H01Q 9/26*** | (2006.01) |
| ***H01Q 5/00*** | (2006.01) |

(52) U.S. Cl.

CPC . *H01Q 9/42* (2013.01); *H01Q 1/38* (2013.01); *H01Q 9/26* (2013.01); *H01Q 5/0072* (2013.01)

USPC ..... 343/725; 343/702; 343/795; 343/803; 343/806

(58) Field of Classification Search

CPC ..... H01Q 1/38; H01Q 5/0072; H01Q 9/26; H01Q 9/42

USPC ..... 343/700 MS, 702, 725, 727, 730, 795, 343/803, 806

See application file for complete search history.

(56) References Cited

U.S. PATENT DOCUMENTS

| | | | | |
|---|---|---|---|---|
| 6,211,840 | B1 * | 4/2001 | Wood et al. | 343/793 |
| 6,329,954 | B1 * | 12/2001 | Fuchs et al. | 343/725 |
| 6,664,930 | B2 * | 12/2003 | Wen et al. | 343/702 |

(Continued)

FOREIGN PATENT DOCUMENTS

| | | |
|---|---|---|
| CN | 2919568 | 7/2007 |
| JP | 2004-129062 | 4/2004 |

(Continued)

OTHER PUBLICATIONS

International Search Report issued Mar. 13, 2012 in International (PCT) Application No. PCT/JP2011/006945.

(Continued)

*Primary Examiner* — Tho G Phan

(74) *Attorney, Agent, or Firm* — Wenderoth, Lind & Ponack, L.L.P.

(57) ABSTRACT

An antenna apparatus includes a dipole antenna, a first monopole antenna and a second monopole antenna, each formed in a form of a conductor pattern on an insulating substrate. A fifth portion of the first monopole antenna and a seventh portion of the second monopole antenna are formed to be adjacent to and to be substantially parallel to a grounding conductor provided outside the antenna apparatus. The fifth portion includes a loop portion, and the seventh portion includes a loop portion.

7 Claims, 8 Drawing Sheets

(56) References Cited

U.S. PATENT DOCUMENTS

| | | | | |
|---|---|---|---|---|
| 7,095,372 | B2 * | 8/2006 | Soler Castany et al. MS | 343/700 |
| 8,659,500 | B2 * | 2/2014 | Wu | 343/893 |
| 2009/0073048 | A1 | 3/2009 | Kim | |

FOREIGN PATENT DOCUMENTS

| | | |
|---|---|---|
| JP | 3121551 | 4/2006 |
| JP | 2007-281906 | 10/2007 |
| JP | 2010-10990 | 1/2010 |

OTHER PUBLICATIONS

Translation of International Preliminary Report on Patentability issued Oct. 10, 2013 in International (PCT) Application No. PCT/JP2011/006945.

Chinese Search Report (SR) issued Dec. 11, 2013 in corresponding Chinese Patent Application No. 201180011600.2.

* cited by examiner

ANTENNA APPARATUS INCLUDING FIRST AND SECOND MONOPOLE ANTENNAS EACH HAVING LOOP PORTION

This is a continuation application of International application No. PCT/JP2011/006945 as filed on Dec. 13, 2011, which claims priority to Japanese patent application No. JP 2011-057495 as filed on Mar. 16, 2011, the contents of which are incorporated herein by reference.

BACKGROUND

1. Technical Field

The present disclosure relates to an antenna apparatus including a plurality of antenna elements, a wireless communication apparatus including the antenna apparatus, and an electronic apparatus having the wireless communication apparatus.

2. Description of the Related Art

BACKGROUND ART

Portable electronic apparatus including a wireless communication apparatus and a display has been popularized. In this case, the wireless communication apparatus receives broadcasting signals such as broadcasting signals of digital terrestrial television broadcasting, and the display apparatus displays a received broadcasting signal. As a method for achieving reception with high sensitivity, such electronic apparatus uses adaptive control such as a combined diversity method to combine received signals received in in-phase by a plurality of antenna elements. In addition, it is necessary to provide a plurality of antenna elements inside or outside a casing of an electronic apparatus in order to perform adaptive control, and various methods are proposed about the configuration and arrangement methods of the plurality of antenna elements (See Japanese Patent Laid-open Publication No. JP 2007-281906 A, for example).

In the electronic apparatus as described above, it is often the case where there is no choice but to place the antenna elements in the neighborhood of a conductor such as a grounding conductor of a circuit board in the electronic apparatus or a shield plate, due to a reduced size of the electronic apparatus. In this case, if an antenna element is placed to be substantially parallel to the conductor, then a mirror image current flows at a position symmetrical to the antenna element with respect to the conductor, in a direction opposite to a direction of an antenna current flowing through the antenna element. Therefore, a magnetic flux induced by the antenna current and a magnetic flux induced by the mirror image current cancel each other, and this led to a decreased combined magnetic flux.

SUMMARY

In one general aspect, the present disclosure describes an antenna apparatus that includes a plurality of antenna elements, a wireless communication apparatus including the antenna apparatus, and an electronic apparatus including the wireless communication apparatus, each capable of solving the above-described problems and capable of preventing the decrease in the combined magnetic flux as compared with the prior art.

An antenna apparatus according to a first disclosure is an antenna apparatus including a dipole antenna, a first monopole antenna and a second monopole antenna, each formed in a form of a conductor pattern on an insulating substrate. The dipole antenna includes a first antenna element and a second antenna element. The first antenna element includes a first portion that has one end connected to a first feeding point and extends in a predetermined first direction, and a second portion that has one end connected to another end of the first portion and extends in a predetermined second direction. The second antenna element includes a third portion that has one end connected to a second feeding point and extends in the first direction, and a fourth portion that has one end connected to another end of the third portion and extends in a predetermined third direction. The first monopole antenna includes a fifth portion that has one end connected to a third feeding point and extends in the second direction, and a sixth portion that has one end connected to another end of the fifth portion and extends in the first direction. The second monopole antenna includes a seventh portion that has one end connected to a fourth feeding point and extends in the third direction, and an eighth portion that has one end connected to another end of the seventh portion and extends in the first direction. Each of the fifth and seventh portions is formed to be adjacent to and to be substantially parallel to a conductor provided outside the antenna apparatus. The fifth portion includes a first loop portion, and the seventh portion includes a second loop portion.

In the above-described antenna apparatus, the second portion preferably includes a first bent portion formed at another end portion of the second portion, and the fourth portion preferably includes a second bent portion formed at another end portion of the fourth portion.

In addition, in the above-described antenna apparatus, the second portion preferably includes a third bent portion formed in a middle portion of the second portion, and the fourth portion preferably includes a fourth bent portion formed in a middle portion of the fourth portion.

Further, the above-described antenna apparatus preferably further includes a parasitic element that operates as a reflector to reflect radio waves transmitted and received by means of the dipole antenna.

Still further, in the above-described antenna apparatus, the first, third, sixth and eighth portions are preferably formed to be substantially parallel to each other so that the first and third portions operate as reflectors to reflect radio waves transmitted and received by means of the sixth and eighth portions.

A wireless communication apparatus according to a second disclosure includes the above-described antenna apparatus, and a wireless communication circuit that transmits and receives a wireless signal by means of the antenna apparatus.

An electronic apparatus according to a third disclosure includes the above-described wireless communication apparatus, and a display apparatus to display a video signal included in the wireless signal.

According to the antenna apparatus, the wireless communication apparatus and the electronic apparatus of the present disclosure, each of the fifth and seventh portions is formed to be adjacent to and to be substantially parallel to the conductor provided outside the antenna apparatus, the fifth portion includes the first loop portion, and the seventh portion includes the second loop portion. Therefore, the decrease in the combined magnetic flux can be prevented.

BRIEF DESCRIPTION OF THE DRAWINGS

These and other objects and features of the present disclosure will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
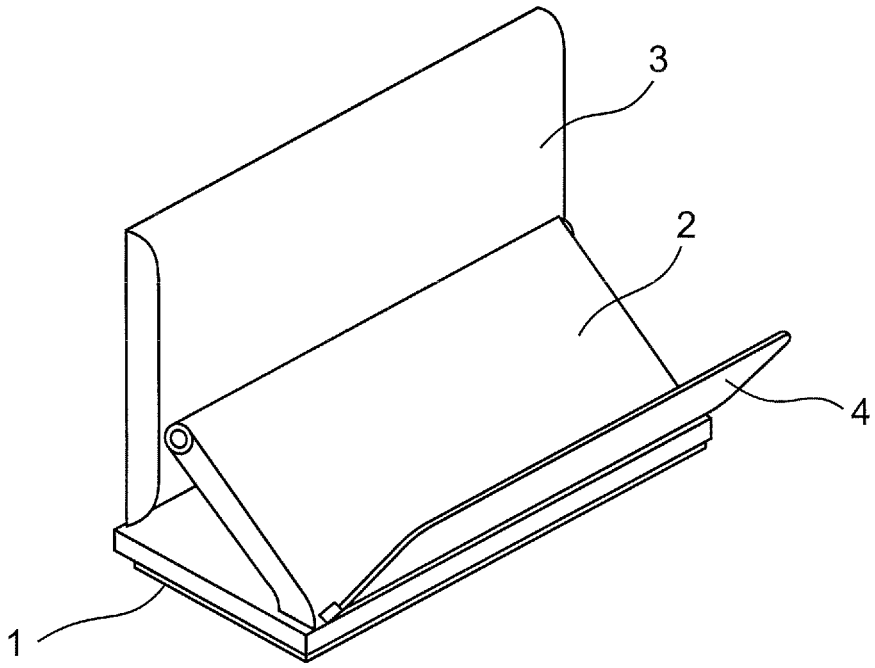
FIG. 1 is a perspective view of an electronic apparatus according to a preferred embodiment of the present disclosure.
Figure 2:
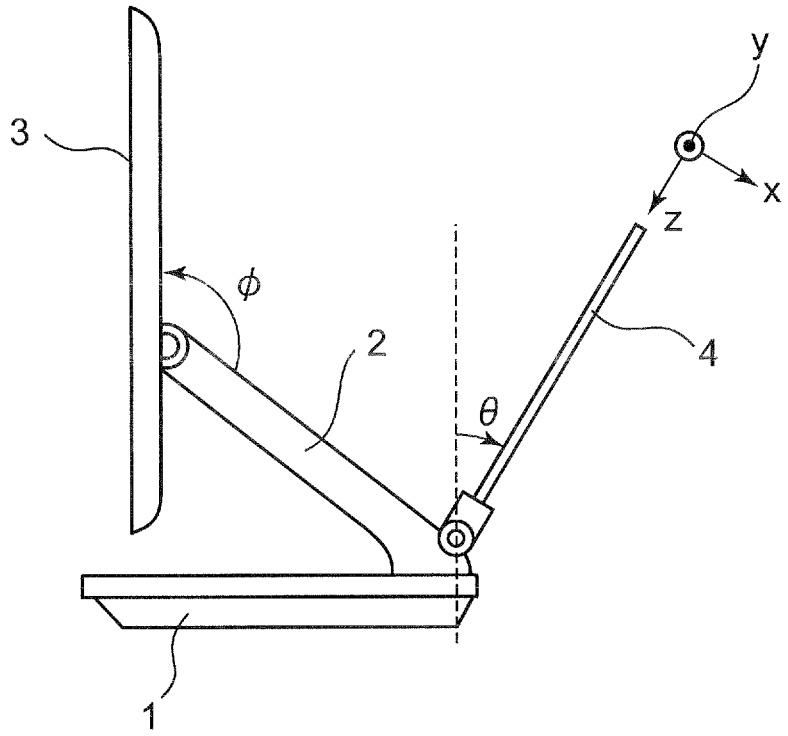
FIG. 2 is a side view of the electronic apparatus of FIG. 1.
Figure 3:
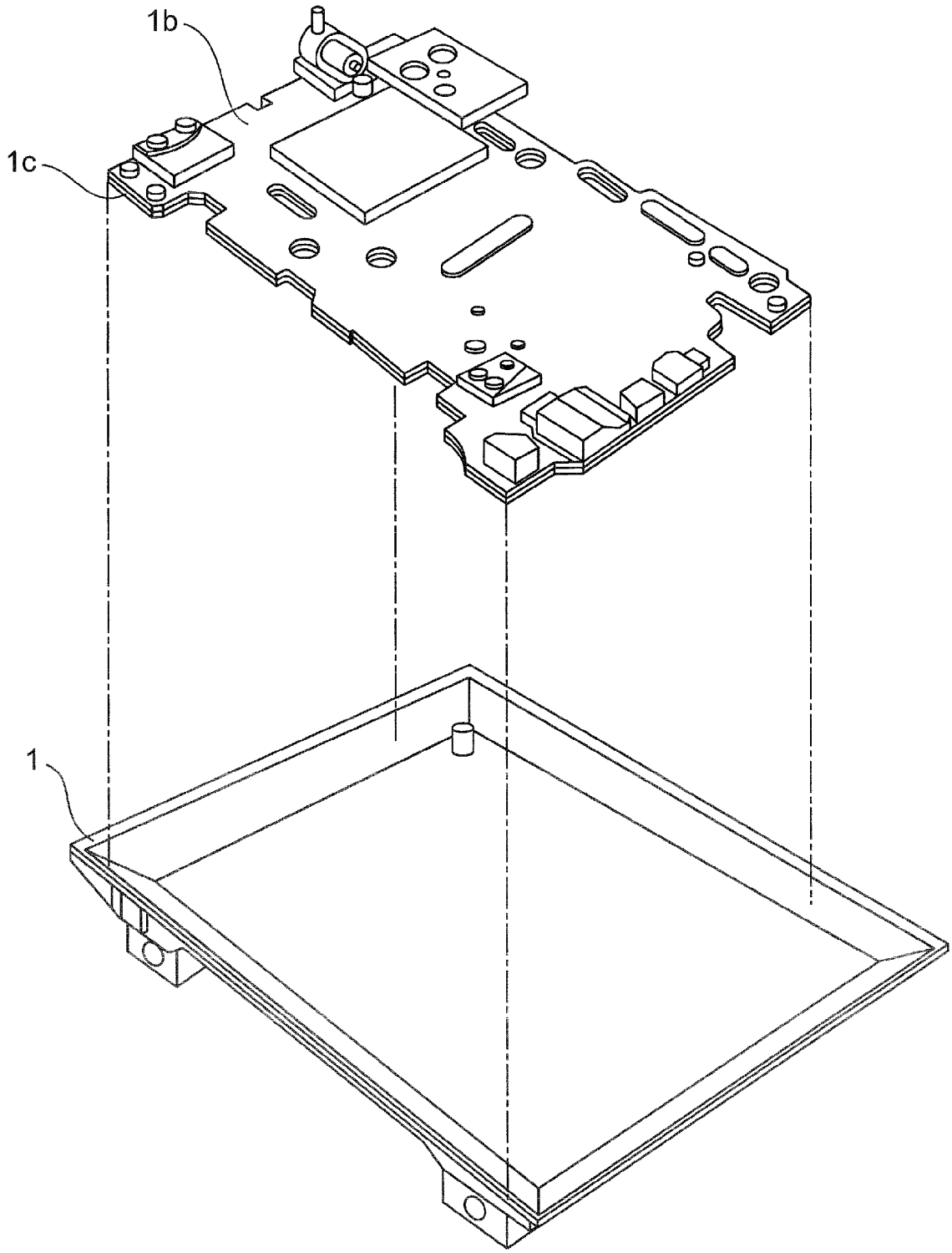
FIG. 3 is an exploded perspective view of a main unit casing 1 of FIG. 1.

Preferred embodiments of the present disclosure will be described hereinafter with reference to the drawings. In the preferred embodiments, components similar to each other are denoted by the same reference numerals, FIG. 1 is a perspective view of an electronic apparatus according to the preferred embodiment of the present disclosure, and FIG. 2 is a side view of the electronic apparatus of FIG. 1. In addition, FIG. 3 is an exploded perspective view of a main unit casing 1 of FIG. 1. The electronic apparatus of the present preferred embodiment is a portable type television broadcasting receiver apparatus for receiving radio waves within a frequency band (473 MHz to 767 MHz) of digital terrestrial television broadcasting. Referring to FIGS. 1 and 2, the electronic apparatus of the present preferred embodiment is configured to include the main unit casing 1, a support arm 2, a display apparatus 3, and an antenna apparatus 4. In the present preferred embodiment, an xyz coordinate system is defined on the antenna apparatus 4 as shown in FIG. 2. Concretely speaking, referring to FIG. 2, a direction, that is perpendicular to the antenna apparatus 4 and is away from the display apparatus 3, is defined as a positive direction of the x axis, a direction, that is parallel to the antenna apparatus 4 and extends in a leftward direction when viewing the display apparatus 3, is defined as a positive direction of the y axis, and a direction, that is parallel to the antenna apparatus 4 and extends in a downward direction in FIG. 2, is defined as a positive direction of the z axis.

Referring to FIGS. 1 and 2, the support arm 2 is formed of resin, and a rear end portion of the support arm 2 is fixed to the main unit casing 1. In addition, the display apparatus 3 is, for example, a liquid crystal display apparatus or an organic EL (Electronic-Luminescence) display apparatus, which has a thin flat shape, and is pivotably supported to a leading end portion of the support arm 2. Further, the antenna apparatus 4 is pivotably supported to the rear end portion of the support arm 2. In this case, the rotational angle $\phi$ of the display apparatus 3 and the rotational angle $\theta$ of the antenna apparatus 4 are defined as shown in FIG. 2. In addition, the antenna apparatus 4 is an antenna apparatus using diversity reception system. The antenna apparatus 4 receives the broadcasting signal of the digital terrestrial television broadcasting by using a dipole antenna 6 and monopole antennas 7 and 8 (See FIG. 4) described later in detail, amplifies respective received signals, and outputs amplified received signals.

In addition, referring to FIG. 3, a main board 1*b* for controlling the entire electronic apparatus is built in the main unit casing 1. Concretely speaking, on the upper surface of the main board 1*b*, there are provided a power supply circuit to supply power voltages to respective circuits on the main board 1*b*, a drive circuit to display an image by driving the display apparatus 3, a tuner and a drive circuit. In this case, the tuner is a wireless communication circuit to combine three received signals from the antenna apparatus 4 into one received signal by executing diversity processing on the three received signals, and output a video signal and an audio signal included in a combined received signal. The drive circuit displays an image on the display apparatus 3 by executing predetermined image processing on the video signal from the tuner by driving the display apparatus 3. In addition, a grounding conductor 1*c* (ground pattern) is formed of, for example, a copper foil on the lower surface of the main board 1*b*. Further, the main unit casing 1 has a sound processing circuit which executes predetermined processing on the audio signal from the tuner and outputs a resultant signal to a loudspeaker, a recording apparatus and a reproducing apparatus for the video signal and the audio signal, and a metal member for heat radiation to reduce heat generated from parts such as the main board 1*b* and so on. Referring to FIG. 3, a part of the main unit casing 1 that covers the upper part of the main board 1*b* is not shown. In addition, the antenna apparatus 4 and the above-described tuner constitute a wireless communication apparatus to receive wireless signals.

Figure 4:
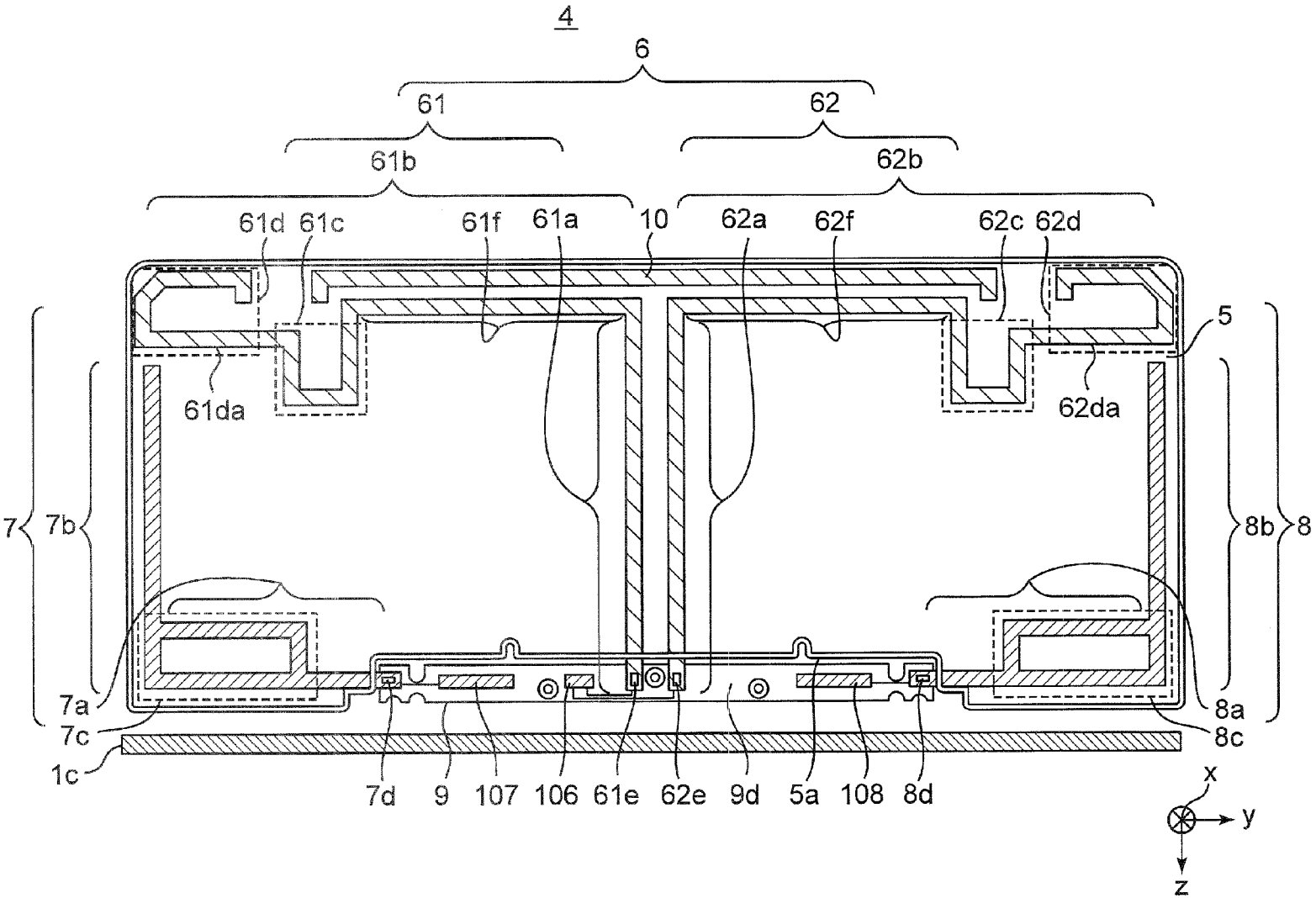
FIG. 4 is a top view showing a position of a grounding conductor 1*c* of FIG. 3 with respect to an antenna apparatus 4 of FIG. 1, and configurations of an insulating substrate 5 and a feeder circuit substrate 9 provided in the antenna apparatus casing of the antenna apparatus 4.
Figure 5:
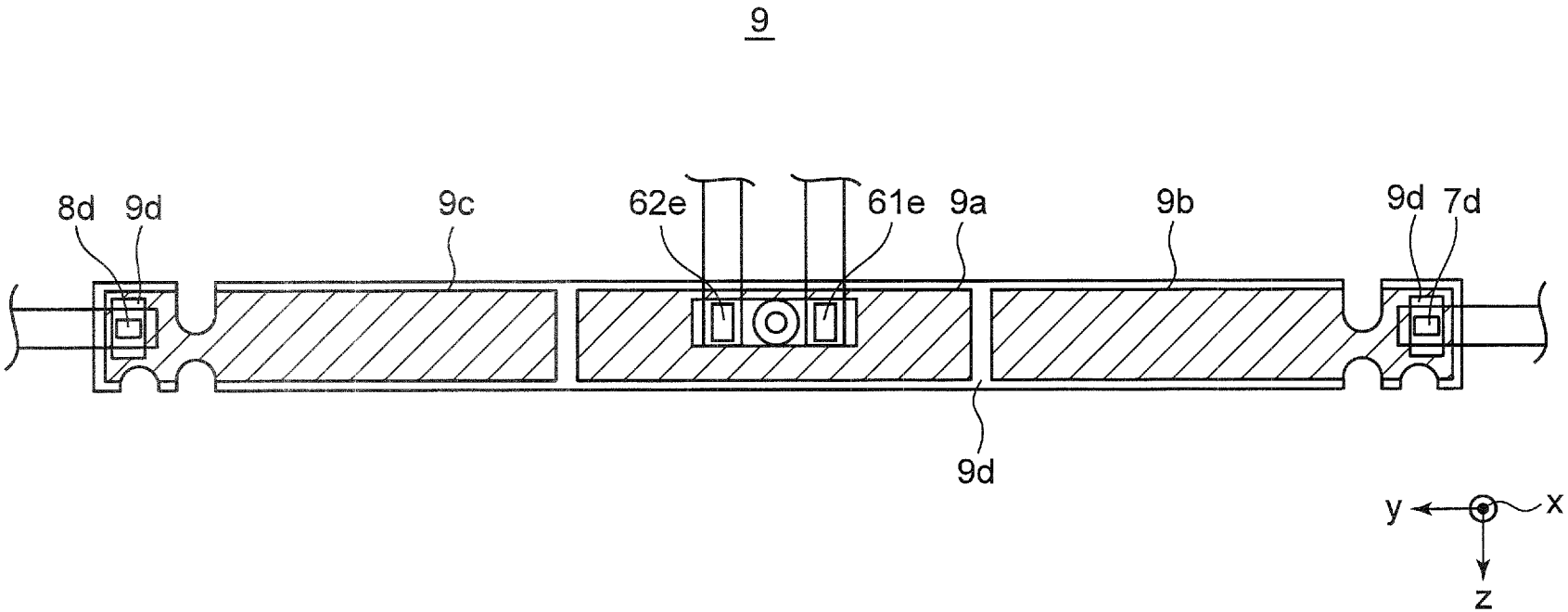
FIG. 5 is a bottom view of the feeder circuit substrate 9 of FIG. 4.

FIG. 4 is a top view showing a position of the grounding conductor 1*c* of FIG. 3 with respect to the antenna apparatus 4 of FIG. 1, and configurations of an insulating substrate 5 and a feeder circuit substrate 9 provided in the antenna apparatus casing of the antenna apparatus 4. In addition, FIG. 5 is a bottom view of the feeder circuit substrate 9 of FIG. 4. Referring to FIG. 4, the antenna apparatus 4 is configured to include the insulating substrate 5 made of a flat-plate-shaped acrylic resin, the feeder circuit substrate 9, the dipole antenna 6, the monopole antennas 7 and 8, and a parasitic element 10. Further, referring to FIGS. 4 and 5, the feeder circuit substrate 9 is a two-layer substrate that has a dielectric layer 9*d* and a conductive layer formed on the lower surface of the dielectric layer 9*d*. As shown in FIG. 4, feeder circuits (antenna circuits) 106, 107 and 108 are mounted on the upper surface of the dielectric layer 9*d*. In addition, as shown in FIG. 5, the conductor layer on the lower surface of the dielectric layer 9*d* includes grounding conductors 9*a*, 9*b* and 9*c* that are electrically insulated from each other.

Referring to FIG. 4, the insulating substrate 5 has a rectangular shape, and has a recess portion 5*a* on the longer side of the insulating substrate 5 to be attached to the rear end portion of the support arm 2. The recess portion 5*a* is provided at a portion of the antenna apparatus casing of the antenna apparatus 4 to be attached to the main unit casing apparatus 1. In addition, the feeder circuit substrate 9 is provided in the recess portion 5*a*.

In addition, referring to FIG. 4, each of the dipole antenna 6, the monopole antennas 7 and 8 and the parasitic element 10 is formed in a form of, for example, a conductor pattern, which is made of a metal such as copper and has a constant width of 3 mm. It is noted that the dipole antenna 6, the monopole antennas 7 and 8 and the parasitic element 10 can be formed by printing a metal pattern, attaching a metal film, forming a metal wire, etching of metal or the like.

Referring to FIG. 4, the dipole antenna 6 is a dual-band dipole antenna, which receives a radio wave having a resonance frequency f1 within a high-frequency band of the frequency band (473 MHz to 767 MHz) of the digital terrestrial television broadcasting, and radio waves having a resonance frequency f2 (f2<f1) within a low-frequency band of the frequency band of the digital terrestrial television broadcasting. In this case, the dipole antenna 6 is configured to include antenna elements 61 and 62. The antenna elements 61 and 62 have shapes symmetrical with respect to the z axis.

In this case, the antenna element 61 includes a first portion 61*a* and a second portion 61*b*. The first portion 61*a* has one end, which is a feeding point 61*e* connected to a feeder circuit 106, and extends from the feeding point 61*e* in the negative direction of the z axis. In addition, the second portion 61*b* has one end connected to another end of the first portion 61*a* and another end which is an open end, and extends in the negative direction of the y axis in the vicinity of the upper side of the insulating substrate 5. In this case, the second portion 61*b* includes a linear portion 61*f* connected to another end of the first portion 61*a*, a bent portion 61*c* and a bent portion 61*d*. It is noted that the first portion 61*a* and the linear portion 61*f* are substantially perpendicular to each other. In addition, the bent portion 61*c* is formed in the middle portion of the second portion 61*b*, and is bent four times substantially at right angles in a U-figured shape. The bent portion 61*d* is provided at the leading end portion of the second portion 61*b*, and is bent four times in a C-figured shape. In this case, a portion 61*da*, which is connected to the bent portion 61*c*, of the bent portion 61*d* is substantially parallel to the linear portion 61*f*.

Referring to FIG. 4, the antenna element 62 includes a third portion 62*a* and a fourth portion 62*b*. The third portion 62*a* has one end which is a feeding point 62*e* connected to the feeder circuit 106, and extends from the feeding point 62*e* in the negative direction of the z axis. In addition, the fourth portion 62*b* has one end connected to another end of the third portion 62*a*, and another end which is an open end, and extends in the positive direction of the y axis in the vicinity of the upper side of the insulating substrate 5. In this case, the fourth portion 62*b* includes a linear portion 62*f* connected to another end of the third portion 62*a*, a bent portion 62*c* and a bent portion 62*d*. It is noted that the third portion 62*a* and the linear portion 62*f* are substantially perpendicular to each other. In addition, the bent portion 62*c* is formed in the middle portion of the second portion 62*b*, and is bent four times substantially at right angles in a U-figured shape. The bent portion 62*d* is provided at the leading end portion of the second portion 62*b*, and is bent four times in a C-figured shape. In this case, a portion 62*da*, which is connected to the bent portion 62*c*, of the bent portion 62*d* is substantially parallel to the linear portion 62*f*.

Referring to FIG. 4, the second portion 61*b* and the fourth portion 62*b* diverges laterally from another ends of the first portion 61*a* and the third portion 61*a*, respectively, and extend. In addition, the bent portions 61*c* and 62*c* operate as high-frequency blocking inductors that interrupt signals having frequencies of equal to or higher than the resonance frequency f1, and pass therethrough signals having frequencies lower than the resonance frequency f1. In this case, a total electrical length of the first portion 61*a*, the linear portion 61*f*, the third portion 62*a* and the linear portion 62*f* is set to half of the wavelength of a radio wave having the resonance frequency f1. In addition, the total electrical length of the antenna elements 61 and 62 is set to half of the wavelength of a radio wave having the resonance frequency f2.

In addition, referring to FIG. 4, the parasitic element 10 is a strip conductor formed so as to extend in the direction of the y axis in the vicinity of the upper side of the insulating substrate 5. The parasitic element 10 is opposed to the linear portions 61*f* and 62*f*. Both ends of the parasitic element 10 are bent in the negative direction of the z axis. The parasitic element 10 operates as a reflector to reflect the radio wave received by using the dipole antenna 6.

Referring to FIG. 4, the monopole antenna 7 includes a fifth portion 7*a* and a sixth portion 7*b*. The fifth portion 7*a* has one end, which is a feeding point 7*d* connected to the feeder circuit 107, and extends from the feeding point 7*d* in the negative direction of the y axis in the vicinity of the lower side of the insulating substrate 5. In addition, the fifth portion 7*a* is formed to be adjacent to and to be substantially parallel to the grounding conductor 1*c* of the main board 1*b*. The sixth portion 7*b* has one end connected to another end of the fifth portion 7*a* and another end which is an open end, and extends in the negative direction of the z axis toward the bent portion 61*d*. Further, a squarely bent loop portion 7*c* is formed in a boundary portion of the fifth portion 7*a* and the sixth portion 7*b* at the fifth portion 7*a*. Preferably, the fifth portion 7*a* is formed adjacent to the grounding conductor 1*c* of the main board 1*b* so that the fifth portion 7*a* is electromagnetically coupled to the grounding conductor 1.

Referring to FIG. 4, the monopole antenna 8 has a shape symmetrical to the antenna element 7 with respect to the z axis, and includes a seventh portion 8*a* and an eighth portion 8*b*. The seventh portion 8*a* has one end, which is a feeding point 8*d* connected to the feeder circuit 108, and extends from the feeding point 8*d* in the positive direction of the y axis in the vicinity of the lower side of the insulating substrate 5. In addition, the seventh portion 8*a* is formed to be adjacent to and to be substantially parallel to the grounding conductor 1*c* of the main board 1*b*. The eighth portion 8*b* has one end connected to another end of the seventh portion 8*a* and another end which is an open end, and extends in the negative direction of the z axis toward the bent portion 62*d*. Further, a squarely bent loop portion 8*c* is formed in a boundary portion of the seventh portion 8*a* and the eighth portion 8*b* at the seventh portion 8*a*. Preferably, the seventh portion 8*a* is formed adjacent to the grounding conductor 1*c* of the main board 1*b* so that the seventh portion 8*a* is electromagnetically coupled to the grounding conductor 1.

It is noted that the first portion 61*a*, the third portion 62*a*, the sixth portion 7*b* and the eighth portion 8*b* are substantially parallel to each other. In addition, the first portion 61*a* is longer than the sixth portion 7*b*, and the third portion 62*a* is longer than the eighth portion 8*b*. Therefore, the first portion 61*a* and the third portion 62*a* operate as reflectors to reflect the radio waves received by using the sixth portion 7*b* and the eighth portion 8*b*.

In the present preferred embodiment, the resonance frequencies of the monopole antennas 7 and 8 are set to substantially the same frequencies in the frequency band (473 MHz to 767 MHz) of the digital terrestrial television broadcasting.

Referring to FIG. 4, the feeder circuit 106 has a balun that is a balanced to unbalanced converter circuit, an impedance matching circuit and a low-noise amplifier circuit. The feeder circuit 106 subjects the received signal received by the dipole antenna 6 to balance-to-unbalanced conversion, executes impedance matching processing, and thereafter, performs low-noise amplification, and outputs a resultant signal to the tuner on the main board 1*b*. In addition, the feeder circuit 107 has an impedance matching circuit and a low-noise amplifier circuit. The feeder circuit 107 executes impedance matching processing on the received signal received by the monopole antenna 7, performs low-noise amplification, and outputs a resultant signal to the tuner on the main board 1*b*. Further, the feeder circuit 108 has an impedance matching circuit and a low-noise amplifier circuit. The feeder circuit 108 executes impedance matching processing of the received signal received by the monopole antenna 8, performs low-noise amplification, and outputs a resultant signal to the tuner on the main board 1*b*. It is noted that the feeding points 61*e*, 62*e*, 7*d* and 8*d* are electrically connected to conductor pads (not shown) of the power supply circuit board, respectively, by using connecting parts such as springs.

In this case, a grounding terminal of the feeder circuit 106 is connected to the grounding conductor 9*a* to be grounded, a grounding terminal of the feeder circuit 107 is connected to the grounding conductor 9*b* to be grounded, and a grounding terminal of the feeder circuit 108 is connected to the grounding conductor 9*c* to be grounded. Therefore, ground potentials to the feeder circuits 106, 107 and 108 are given by the grounding conductors 9*a*, 9*b* and 9*c*, respectively. It is noted that, when the radio wave is received by the dipole antenna 6, the received signal after the balance-to-unbalance conversion by the above-described balun is subsequently processed in a form of an unbalanced signal, and a ground current caused by the received signal flows through the grounding conductor 9*a*. In addition, when radio waves are received by the monopole antenna 7, the received signal received by the monopole antenna 7 is outputted to the feeder circuit 107, and the ground current of the received signal generated following the receiving operation of the dipole antenna 6 flows through the grounding conductor 9*b*. Further, when radio waves are received by the monopole antenna 8, the received signal received by the monopole antenna 8 is outputted to the feeder circuit 108, and the ground current of the received signal generated following the receiving operation of the monopole antenna 8 flows through the grounding conductor 9*c*.

Figure 6:
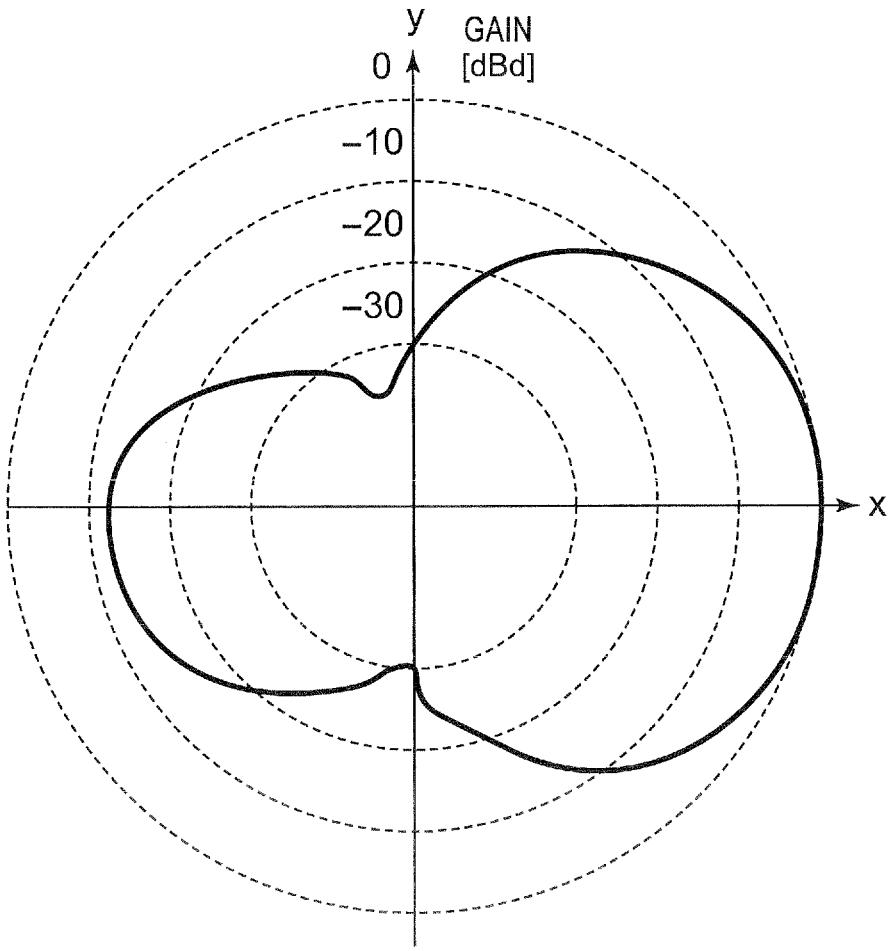
FIG. 6 is a graph showing a radiation pattern on an xy plane of a dipole antenna 6 of FIG. 4.
Figure 7:
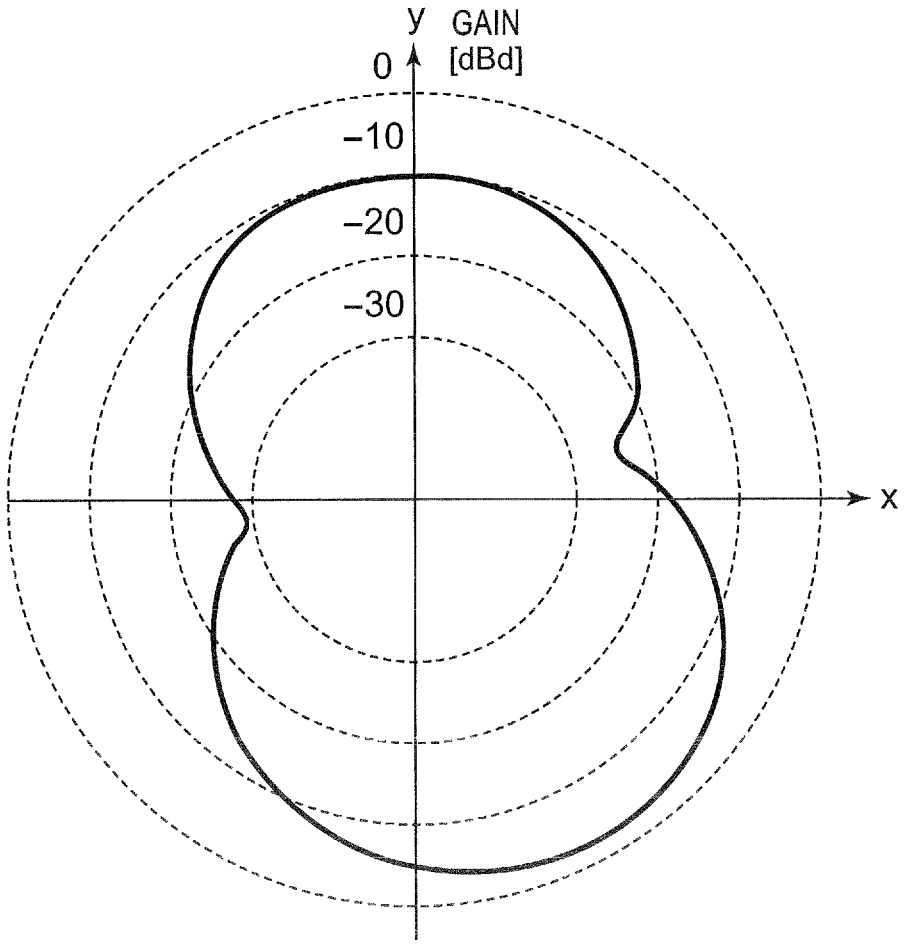
FIG. 7 is a graph showing a radiation pattern on the xy plane of a monopole antenna 7 of FIG. 4.
Figure 8:
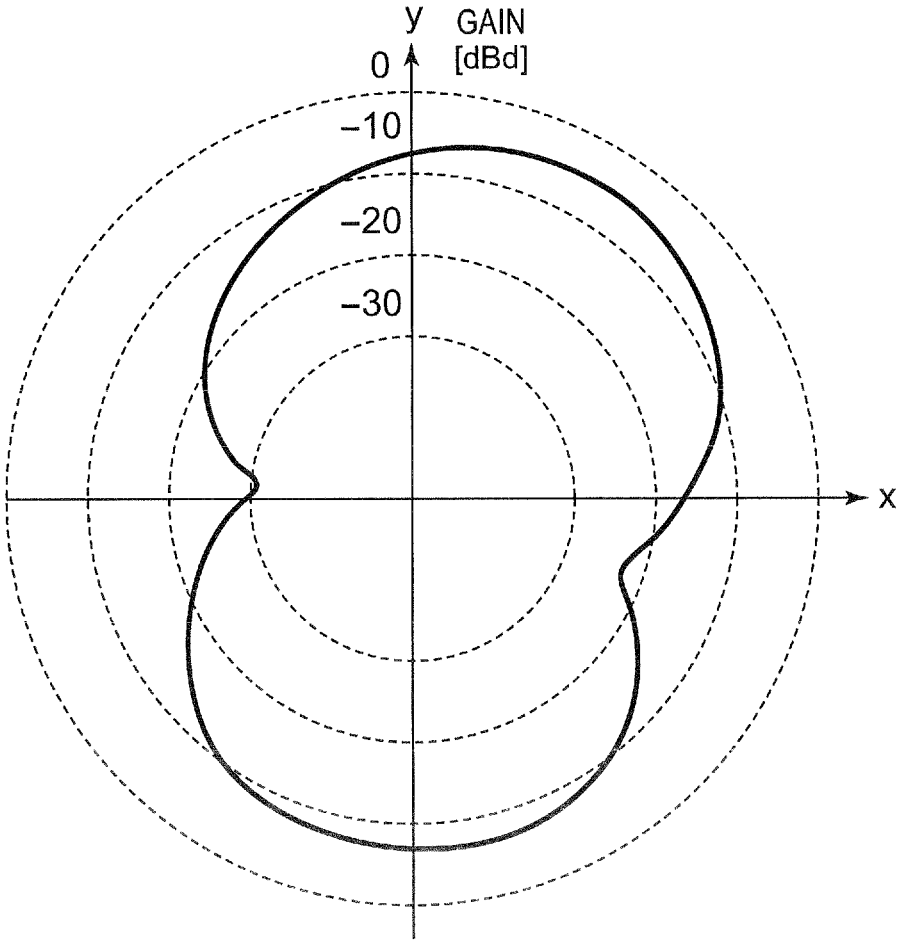
FIG. 8 is a graph showing a radiation pattern on the xy plane of the monopole antenna 8 of FIG. 4.

FIGS. 6, 7 and 8 are graphs showing the radiation patterns on an xy plane of the dipole antenna 6 of FIG. 4, the monopole antenna 7 of FIG. 4 and the monopole antenna 8 of FIG. 4, respectively. As shown in FIG. 6, the dipole antenna 6 has a high gain in a direction of the back surface of the display apparatus 3. This is because the metal frame of the display apparatus 3 placed on the front surface side of the antenna apparatus 4 and the like are operating as reflectors with respect to the antenna apparatus 4. In addition, as shown in FIG. 7, the monopole antenna 7 has a high gain in the rightward direction when viewing the display surface of the display apparatus 3. This is because the first portion 61*a* and the third portion 62*a* of the dipole antenna 6 are operating as reflectors with respect to the monopole antenna 7. Further, as shown in FIG. 8, the monopole antenna 8 has a high gain in the leftward direction when viewing the display surface of the display apparatus 3. This is because the first portion 61*a* and the third portion 62*a* of the dipole antenna 6 are operating as reflectors with respect to the monopole antenna 8.

Figure 9:
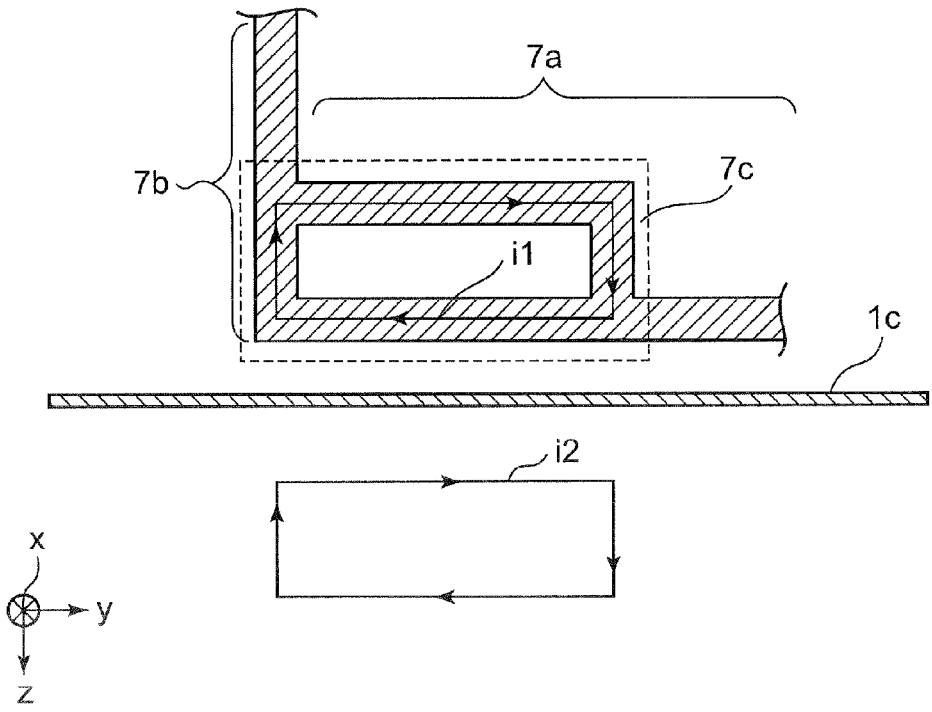
FIG. 9 is a plan view showing an antenna current it flowing through a loop portion 7*c* of FIG. 4, and a mirror image current i2 of the antenna current i1 when the grounding conductor 1*c* is a plane of symmetry.

The loop portion 7*c* of FIG. 4 is described next. FIG. 9 is a plan view showing an antenna current i1 flowing through the loop portion 7*c* of FIG. 4, and a mirror image current i2 of the antenna current i1 when the grounding conductor 1*c* is a plane of symmetry. Generally speaking, it is often the case where there is no choice but to place the antenna elements in the neighborhood of a conductor such as a grounding conductor of a circuit board in the electronic apparatus or a shield plate, due to a reduced size of the electronic apparatus. In this case, if an antenna element is placed substantially parallel to the conductor, then a mirror image current flows at a position symmetrical to the antenna element with respect to the conductor, in a direction opposite to a direction of an antenna current flowing through the antenna element. Therefore, a magnetic flux induced by the antenna current and a magnetic flux induced by the mirror image current cancel each other, and this led to a decreased combined magnetic flux.

In contrast to this, in the present preferred embodiment, as shown in FIG. 9, the loop portion 7*c* is provided in a portion adjacent to and opposite to the grounding conductor 1*c* of the monopole antenna 7. Therefore, the antenna current i1 of an eddy current flows through the loop portion 7*c* during the reception by the monopole antenna 7. Further, the mirror image current i2 reverse to the eddy current i1 flows in a position symmetrical to the antenna current it with respect to the grounding conductor 1*c*. As a result, a component that flows from the right to the left in FIG. 9 of the antenna current i1 and a component that flows from the left to the right in FIG. 9 of the mirror image current i2 cancel each other. Therefore, since the component that flows from the left to the right in FIG. 9 of the antenna currents i1 remains without being canceled by the mirror image current i2, it is possible to prevent the decrease in the combined magnetic flux. It is noted that the loop 8*c* also functions in a manner similar to that of the loop portion 7*c*, and it is possible to prevent the decrease in the combined magnetic flux.

In addition, according to the dipole antenna 6 of the present preferred embodiment, the bent portions 61*d* and 62*d* are provided at the leading end portions of the second portions 61*b* and 62*b*, respectively. Therefore, the dipole antenna 6 can be reduced in size as compared with the case where the leading end portions of the second portions 61*b* and 62*b* are formed in a linear shape. Therefore, the antenna apparatus 4 can be entirely reduced in size.

Further, according to the dipole antenna 6 of the present preferred embodiment, since the bent portions 61*c* and 62*c* that function as inductors are provided, a dual-band dipole antenna having the resonance frequencies f1 and f2 can be actualized. Still further, since the parasitic element 10 is provided, the radio wave from the positive direction of the z axis can be efficiently received as compared with the case where the parasitic element 10 is not provided.

In addition, in the antenna apparatus that receives broadcasting signals such as the broadcasting signals of the digital terrestrial television broadcasting, the receiver sensitivity should preferably be high in various directions. However, when a plurality of antenna elements that use radio waves having frequencies within the same frequency band are used, so as to improve the gain of the antenna apparatus of the electronic apparatus in various directions, the following problem occurs. Namely, signal mixing from the other antenna elements is caused by electromagnetic coupling among the antenna elements, the signal-to-noise ratio at the reception by using each of the antenna elements decreases, and this sometimes leads to a substantially decreased gain. In contrast to this, according to the present preferred embodiment, the ground currents (the ground current of the received signal after the balance-to-unbalance conversion by the above-described balun in the case of the dipole antenna 6) flows through the grounding conductors 9*a*, 9*b* and 9*c*, respectively, during the respective receiving operation of the dipole antenna 6 and the monopole antennas 7 and 8. Therefore, the coupling state among the dipole antenna 6 and the monopole antennas 7 and 8 becomes a coarse coupling state. Therefore, as compared with the case where the ground currents generated during the receiving operation of the dipole antenna 6 and the monopole antennas 7 and 8 flow through the same grounding conductor, the signal mixing from the other antenna elements can be prevented, and the decrease in the gain during the receiving operation of the dipole antenna 6 and the monopole antennas 7 and 8 can be substantially prevented in the antenna apparatus 4 of the present preferred embodiment. Therefore, it is possible to realize the antenna apparatus 4 that has receiver sensitivity higher than that of the prior art in various directions.

Further, since the first portion 61*a* and the third portion 62*a* are formed to be substantially parallel to the sixth portion 7*b* and the eighth portion 8*b*, the radio wave from the leftward direction of FIG. 4 can be efficiently received by the monopole antenna 7, and the radio wave from the rightward direction of FIG. 4 can be received efficiently by the monopole antenna 8.

Still further, the electronic apparatus of the present preferred embodiment has the antenna apparatus 4, and therefore, the electronic apparatus can receive the digital terrestrial television broadcasting sensibility higher than that of the prior art.

The fifth portion 7*a* and the seventh portion 8*a* are formed to be substantially parallel to the grounding conductor 1*c* in the above-described preferred embodiment, however, the present disclosure is not limited to this. The fifth portion 7*a* and the seventh portion 8*a* are only required to be formed to be substantially parallel to a conductor provided outside the antenna apparatus 4.

In addition, the one ends of the first portion 61*a*, the third portion 62*a*, the fifth portion 7*a* and the seventh portion 8*a* are the feeding points 61*e*, 62*e*, 7*d* and 8*d*, respectively, in the above-described preferred embodiment, however, the present disclosure is not limited to this. The first portion 61*a*, each of the third portion 62*a*, the fifth portion 7*a* and the seventh portion 8*a* may have one end connected to a feeding point via electrical connection means such as wiring conductors.

Further, the antenna apparatus 4 of the above-described preferred embodiment includes the parasitic element 10, the second portion 61*b* includes the bent portions 61*c* and 61*d*, the second portion 62*b* includes the bent portions 62*c* and 62*d*, the fifth portion 7*a* includes the loop portion 7*c*, and the seventh portion includes the loop portion 8*c*, however, the present disclosure is not limited to this. In the antenna apparatus 4, the fifth portion 7*a* is only required to include the loop portion 7*c*, and the seventh portion is only required to include the loop portion 8*c*, and the antenna apparatus 4 is only required to include at least one of the bent portions 61*d* and 62*d*, the bent portions 61*c* and 62*c*, and the parasitic element 10.

Still further, the antenna apparatus 4 wirelessly receives the radio waves within the frequency band of the digital terrestrial television broadcasting in the above-described preferred embodiment and its modified preferred embodiment, however, the present disclosure is not limited to this. A high-frequency signal from a wireless transmission circuit may be wirelessly transmitted. In this case, the parasitic element 10 operates as a reflector to reflect the radio waves transmitted by using the dipole antenna 6, and the first portion 61*a* and the third portion 62 operate as reflectors to reflect the radio waves transmitted by using the sixth portion 7*b* and the eighth portion 8*b*.

In addition, the present disclosure has been described by taking the electronic apparatus that is the portable television broadcasting receiver apparatus for receiving the radio waves within the frequency band of the digital terrestrial television broadcasting as an example in the above-described preferred embodiment and its modified preferred embodiment, however, the present disclosure is not limited to this. The present disclosure can be applied to a wireless communication apparatus that has the antenna apparatus 4 and a wireless communication circuit to transmit and receive wireless signals by using the antenna apparatus 4. In addition, the present disclosure can be applied to electronic apparatus such as a portable telephone that has the above-described wireless communication apparatus and a display apparatus to display a video signal included in the wireless signal received by the wireless communication apparatus.

INDUSTRIAL APPLICABILITY

As described above in detail, according to the antenna apparatus, the wireless communication apparatus and the electronic apparatus of the present disclosure, each of the fifth and seventh portions is formed to be adjacent to and to be substantially parallel to the conductor provided outside the antenna apparatus, the fifth portion includes the first loop portion, and the seventh portion includes the second loop portion. Therefore, the decrease in the combined magnetic flux can be prevented.

Although the present disclosure has been fully described in connection with the preferred embodiments thereof with reference to the accompanying drawings, it is to be noted that various changes and modifications are apparent to those skilled in the art. Such changes and modifications are to be understood as included within the scope of the present disclosure as defined by the appended claims unless they depart therefrom.

What is claimed is:

1. An antenna apparatus comprising a dipole antenna, a first monopole antenna and a second monopole antenna, each formed in a form of a conductor pattern on an insulating substrate, wherein the dipole antenna includes:

a first antenna element including a first portion that has one end connected to a first feeding point and extends in a predetermined first direction, and a second portion that has one end connected to another end of the first portion and extends in a predetermined second direction; and a second antenna element including a third portion that has one end connected to a second feeding point and extends in the first direction, and a fourth portion that has one end connected to another end of the third portion and extends in a predetermined third direction, wherein the first monopole antenna includes a fifth portion that has one end connected to a third feeding point and extends in the second direction, and a sixth portion that has one end connected to another end of the fifth portion and extends in the first direction, wherein the second monopole antenna includes a seventh portion that has one end connected to a fourth feeding point and extends in the third direction, and an eighth portion that has one end connected to another end of the seventh portion and extends in the first direction, wherein each of the fifth and seventh portions is formed to be adjacent to and to be substantially parallel to a conductor provided outside the antenna apparatus, wherein the fifth portion includes a first loop portion, and wherein the seventh portion includes a second loop portion.

2. The antenna apparatus as claimed in claim 1, wherein the second portion includes a first bent portion formed at another end portion of the second portion, and the fourth portion includes a second bent portion formed at another end portion of the fourth portion.

3. The antenna apparatus as claimed in claim 1, wherein the second portion includes a third bent portion formed in a middle portion of the second portion, and wherein the fourth portion includes a fourth bent portion formed in a middle portion of the fourth portion.

4. The antenna apparatus as claimed in claim 1, further comprising a parasitic element that operates as a reflector to reflect radio waves transmitted and received by means of the dipole antenna.

5. The antenna apparatus as claimed in claim 1, wherein the first, third, sixth and eighth portions are formed to be substantially parallel to each other so that the first and third portions operate as reflectors to reflect radio waves transmitted and received by means of the sixth and eighth portions.

6. A wireless communication apparatus comprising:

an antenna apparatus comprising a dipole antenna, a first monopole antenna and a second monopole antenna, each formed in a form of a conductor pattern on an insulating substrate; and a wireless communication circuit that transmits and receives a wireless signal by means of the antenna apparatus, wherein the dipole antenna includes:

a first antenna element including a first portion that has one end connected to a first feeding point and extends in a predetermined first direction, and a second portion that has one end connected to another end of the first portion and extends in a predetermined second direction; and a second antenna element including a third portion that has one end connected to a second feeding point and extends in the first direction, and a fourth portion that has one end connected to another end of the third portion and extends in a predetermined third direction, wherein the first monopole antenna includes a fifth portion that has one end connected to a third feeding point and extends in the second direction, and a sixth portion that has one end connected to another end of the fifth portion and extends in the first direction, wherein the second monopole antenna includes a seventh portion that has one end connected to a fourth feeding point and extends in the third direction, and an eighth portion that has one end connected to another end of the seventh portion and extends in the first direction, wherein each of the fifth and seventh portions is formed to be adjacent to and to be substantially parallel to a conductor provided outside the antenna apparatus, wherein the fifth portion includes a first loop portion, and wherein the seventh portion includes a second loop portion.

7. An electronic apparatus comprising:

the wireless communication apparatus comprising an antenna apparatus, and a wireless communication circuit that transmits and receives a wireless signal by means of the antenna apparatus; and a display apparatus to display a video signal included in the wireless signal, wherein the antenna apparatus comprises a dipole antenna, a first monopole antenna and a second monopole antenna, each formed in a foil of a conductor pattern on an insulating substrate, wherein the dipole antenna includes:

a first antenna element including a first portion that has one end connected to a first feeding point and extends in a predetermined first direction, and a second portion that has one end connected to another end of the first portion and extends in a predetermined second direction; and a second antenna element including a third portion that has one end connected to a second feeding point and extends in the first direction, and a fourth portion that has one end connected to another end of the third portion and extends in a predetermined third direction, wherein the first monopole antenna includes a fifth portion that has one end connected to a third feeding point and extends in the second direction, and a sixth portion that has one end connected to another end of the fifth portion and extends in the first direction, wherein the second monopole antenna includes a seventh portion that has one end connected to a fourth feeding point and extends in the third direction, and an eighth portion that has one end connected to another end of the seventh portion and extends in the first direction, wherein each of the fifth and seventh portions is formed to be adjacent to and to be substantially parallel to a conductor provided outside the antenna apparatus, wherein the fifth portion includes a first loop portion, and wherein the seventh portion includes a second loop portion.

* * * * *